United States Patent [19]

Plumlee et al.

[11] 4,051,012

[45] Sept. 27, 1977

[54] COAL LIQUEFACTION PROCESS

[75] Inventors: Karl W. Plumlee; Lonnie W. Vernon, both of Baytown, Tex.

[73] Assignee: Exxon Research & Engineering Co., Linden, N.J.

[21] Appl. No.: 686,827

[22] Filed: May 17, 1976

[51] Int. Cl.[2] ..... C10G 1/04

[52] U.S. Cl. ..... 208/8

[58] Field of Search ..... 208/8, 10

[56] References Cited

U.S. PATENT DOCUMENTS 3,700,583 10/1972 Salamony et al. ..... 208/8

*Primary Examiner*—Delbert E. Gantz
*Assistant Examiner*—James W. Hellwege
*Attorney, Agent, or Firm*—L. A. Proctor

[57] ABSTRACT

A process for liquefying a particulate coal feed to produce useful petroleum-like liquid products by steps which include: (a) contacting, in a liquefaction zone, said coal feed with a hydrogen donor solvent at temperature and pressure sufficient to hydroconvert and liquefy the coal, (b) separating the product from the liquefaction zone by distillation into fractions inclusive of a liquid solvent fraction which contains at least 30 weight percent, and preferably at least 50 weight percent hydrogen donor compounds, particularly those fractions boiling within about the 350°-850° F. range, and preferably within about the 400°-700° F. range, (c) hydrotreating said liquid solvent fraction in a hydrogenation zone in the presence of a quinone catalyst, and (d) recycling the hydrogenated liquid solvent mixture to said coal liquefaction zone.

10 Claims, 1 Drawing Figure

FIGURE
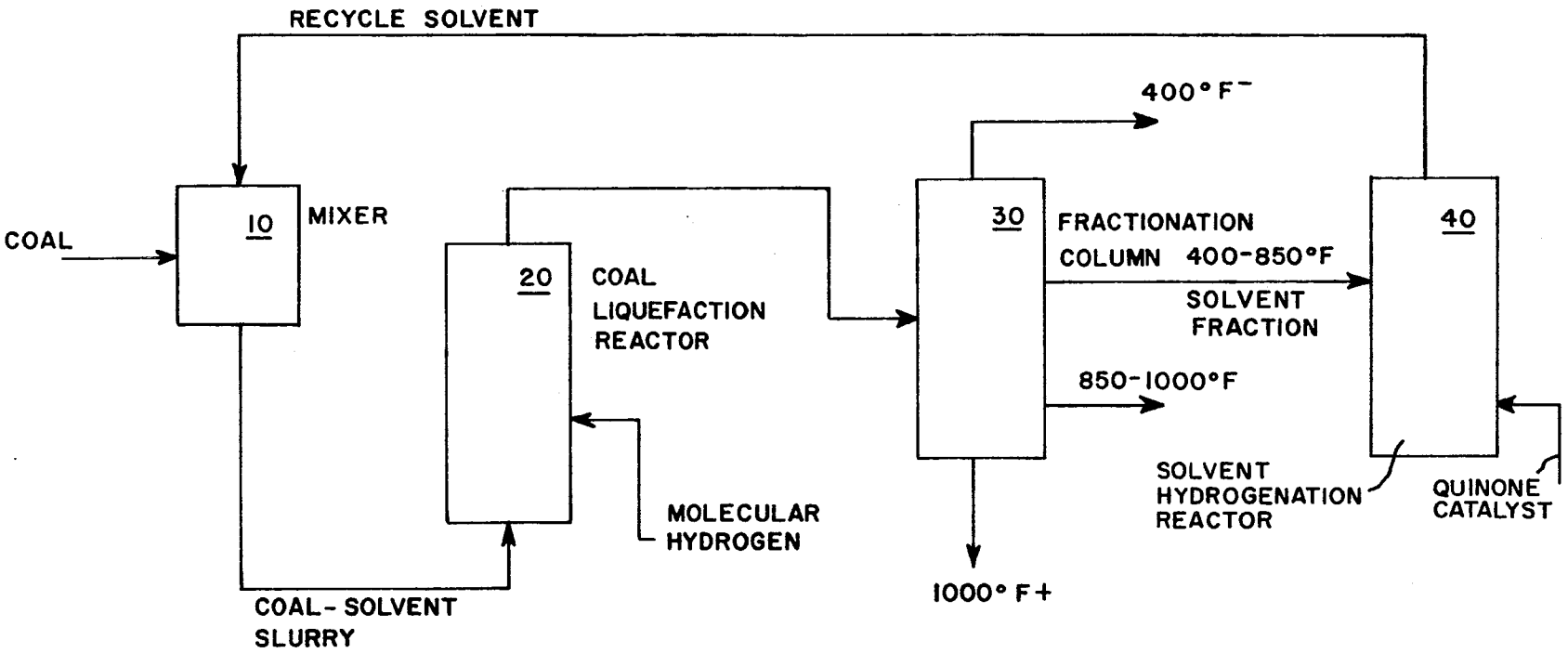

COAL LIQUEFACTION PROCESS

Processes for the conversion of coal into useful petroleum-like liquid products have been known for many years. Of particular interest are those which utilize a hydrogen transfer, or hydrogen donor solvent to hydrogenate and liquefy the coal. In such processes, crushed coal is contacted at elevated temperature and pressure with a solvent, often a liquid fraction derived from within the process, which acts as a hydrogen donor. The solvent supplies hydrogen to the hydrogen-deficient coal molecules, as molecules are thermally cracked and cleaved from the disintegrating coal solids.

In the breaking coal molecules, since coal is largely comprised of polymerized multi-ring aromatic structures, each bond rupture results in the formation of extremely reactive free radicals. When these moities are sufficiently small, and early stabilized by the addition of a hydrogen atom, they are evolved as a portion of the liquid product. If the moities become excessively large, as when the moities form polymeric products, the fragments remain with the char or coke that is produced. If insufficient hydrogen is available, or if the hydrogen is ineffectively utilized, repolymerization of the moities occurs, this producing char or coke, or both.

Carbon radical scavengers have been proposed for use in coal liquefaction reactions, as disclosed, e.g., in U.S. Pat. No. 3,700,583 issued Salamony et al. on Oct. 24, 1972. The Salamony et al. process describes the use of quinones, particularly quinone derivatives of mono- and/or polynuclear aromatic compounds, and certain halogens and halogen halides as carbon-radical scavengers which are added with the hydrogen donor solvent to the coal liquefaction zone to increase the amount of the liquid product, as measured by an increase in the total amount of benzene-soluble liquids in the product. A preferred technique for adding quinones to the solvent, in accordance with Salamony et al., is to treat an indiginous 700°-1000° F. fraction of the liquid product in an oxidation zone to form the quinones, or carbon radical scavengers, in situ. In such step, the vaporized 700°-1000° F. fraction is contacted with air in the presence of an oxidation catalyst at temperatures ranging from about 800°-1000° F., at atmospheric pressure. A second indiginous lower boiling solvent fraction, or fraction boiling at temperatures in the range of about 400° F. to 700° F. produced, in the coal liquefaction, is rehydrogenated in a hydrogenation zone by contact with a heterogeneous catalyst, or catalyst comprised of a Group VIB and/or Group VIII metal hydrogenation component. The products of these reactions are recycled to the coal liquefaction zone. Liquid yields of benzene-soluble hydrocarbons are improved on the order of about 7 to 10 weight percent (MAF coal).

Heterogeneous hydrogenation catalysts have been widely used in the industry, but nonetheless, there are a number of disadvantages associated with the use of these catalysts. Diffusion limitations are perhaps the most notable disadvantage of heterogeneous catalysts. Reactants must thus diffuse into the pores of such catalysts to reach the reactive sites of the catalyst, and the products of such reaction must be removed through the pores of the catalysts. Moreover, there are considerable production and maintenance costs associated with the manufacture, treatment, and regeneration of heterogeneous catalysts to render them suitable, and to maintain the activity of such catalysts for use in any given process. These solids materials also occupy consider reactor volume, and thereby tend to increase the capital costs of any given process.

It is accordingly the primary objective of the present invention to obviate these and other disadvantages associated with such catalysts.

A particular object is to provide a new and improved coal liquefaction process, particularly one which can better utilize coal feeds to produce greater quantities of the more useful liquids without any necessity of using heterogeneous catalysts.

These and other objects are achieved in accordance with the present invention characterized generally as a process for liquefying a coal feed to produce useful petroleum-like liquid products by steps which include: (a) contacting, in a liquefaction zone, said coal feed with a hydrogen donor solvent at temperature and pressure sufficient to hydroconvert and liquefy the coal, (b) separating the product from the liquefaction zone by distillation into fractions inclusive of a liquid solvent fraction which contains at least 30 weight percent, and preferably at least 50 weight percent hydrogen donor compounds, particularly those fractions boiling within about the 350°-850° F. range, and preferably within about the 400°-700° F. range, (c) hydrogenating said liquid solvent fraction in a hydrogenation zone in the presence of a quinone catalyst, and (d) recycling the liquid solvent fraction, and preferably the quinone catalyst, to said coal liquefaction zone.

A quinone compound, or mixture of quinone compounds, is dispersed or dissolved within the solvent fraction that is to be hydrogenated, within the hydrogenation zone, the quinone effectively catalyzing the hydrogenation reaction.

The quinone is a cyclic compound characterized by the presence of the quinoid structure or system wherein two keto or hydroxy groups are connected by a system of conjugated double bonds. It is a mono- or polycyclic hydrocarbon compound which contains two oxygen atoms which occupy either ortho or para positions one oxygen atom relative to the other. Where the quinone is polycyclic, the rings constituting the molecule can be fused or non-fused, or can contain both fused and non-fused rings. The quinone generally contains from 1 to about 6 rings in the total molecule, and preferably from 1 to about 3 rings, with 1 or 2 rings being most preferred. The rings can be substituted or unsubstituted, and in terms of carbon atoms the total molecule can contain from 6 to about 36 carbon atoms, preferably from 6 to about 14 carbon atoms. Sterically unhindered molecules are preferable and, therefore, where substituents are present large branched substituent chains, and highly polar groups are generally to be avoided. The keto or hydroxy groups, while occupying positions ortho or para one to the other, can be on the same ring, or can be located on different rings. Polynuclear polyquinones, particularly diquinones are also satisfactory. Exemplary of quinone compounds suitable for the practice of this invention are such species as o-benzoquinone, p-benzoquinone, 2,5-dichloro-p-benzoquinone, tetrachloro-p-benzoquinone, 1,2-naphthoquinone, 1,4-naphthoquinone, 2-methyl-1,4-naphthoquinone, 2,6-naphthoquinone, 1,2-anthraquinone, 1,4-anthraquinone, 1,7-anthraquinone, 9,10-anthraquinone, phenanthrene quinone, acenaphthene quinone, chrysene quinone, 4,4'-diphenoquinone, 2,2'-diphenoquinone, 4,4'-stilbenequinone, 1,2,3,4,-naphthodiquinone, 1,4,5,8-naphthodiquinone and the like. The ortho quinones are a preferred species, as contrasted with the para quinones.

The quinone compound or admixture of such compounds, in a preferred embodiment, is added to a liquid fraction separated from the liquid products obtained from within the process, suitably a fraction boiling within the range of from about 350° F. to about 850° F., and preferably from about 400° F. to about 700° F. These fractions have been found admirably suitable as a solvent donor, solvent donor vehicle or precursor, and generally contain about 30 percent, and most often about 50 percent, of an admixture of hydrogen donor compounds, adequate to supply the necessary hydrogen under coal liquefaction conditions, based on the total weight of the recycled solvent. Where such amounts of hydrogen donor compounds are not present in a given solvent vehicle, additional amounts of these materials can be produced. Suitably, the quinone compound is added to the solvent fraction in quantity ranging from about 0.01 to about 5 percent, preferably from about 0.1 to about 2 percent, based on the weight of total solvent fed into the coal liquefaction zone.

Preferred hydrogen donor compounds are added to, or generated in situ from precursors contained within a suitable solvent donor vehicle, these including indane, dihydroaphthalene, $C_{10}$–$C_{12}$ tetrahydronaphthalenes, hexahydrofluorine, the dehydro-, tetrahydro-, hexahydro-, and octahydro-phenanthrenes, $C_{12}$–$C_{13}$ acenaphthenes, the tetrahydro-, hexahydro- and decahydropyrenes, the ditetra- and octahydro-anthracenes, and other derivatives of partially saturated aromatic compounds. In terms of hydrogen donor potential, the solvent to which the quinone compound has been added, at the time of its introduction into or use within the coal liquefaction zone, necessarily contains at least about 0.8 percent, and preferably from about 1.2 to about 3 percent of donatable hydrogen, based on the weight of total solvent introduced into the coal liquefaction zone. The preferred hydrogen donor solvent is one produced within the coal liquefaction process, and one which contains suitable quantities of hydrogen donor precursors.

In the best mode of practicing the present invention, a quinone compound, or admixture of such compounds, is employed as a homogenous catalyst to hydrogenate a hydrogen donor solvent fraction produced from within the coal liquefaction process. In such process, schematically illustrated by reference to the figure, the required process steps include (a) a mixing zone 10 within which particulate coal is slurried with an internally generated liquid solvent donor fraction, (b) a coal liquefaction zone 20 within which the coal slurry is fed, and the coal liquefied, (c) a distillation and solids separation zone 30 within which a liquid solvent fraction, a 1000° F.+ heavy bottoms fraction, and liquid product fraction are separated, and (d) a catalytic solvent hydrogenation zone 40 wherein the liquid solvent fraction is hydrogenated in the presence of the quinone catalyst, and the hydrogenated solvent is recycled as a hydrogen donor solvent to said coal liquefaction zone. Preferably the quinone catalyst is recycled with the solvent to the coal liquefaction zone but, if desired, can be removed from the recycle solvent.

In the mixing zone 10, particulate coal of size is ranging up to about ⅛ inch particle size diameter, suitably 8 mesh (Tyler), is slurried in recycle solvent. The solvent and coal are admixed in a solvent-to-coal ratio ranging from about 0.8:1 to about 2:1, preferably about 1.2:1 to about 1.6:1, based on weight. The solvent is one which boils within the range of about 350° F. to about 850° F., preferably from about 400° F. to about 700° F. The coal slurry is fed, with molecular hydrogen, into the coal liquefaction zone 20.

Within the coal liquefaction zone 20, liquefaction conditions include a temperature ranging from about 700° F. to about 950° F., preferably from about 800° F. to about 900° F., with pressures ranging from about 300 psig to about 3000 psig, preferably from about 800 psig to about 2000 psig. Preferably, molecular hydrogen is also added to the liquefaction zone 20 at a rate from about 1 to about 6 weight percent (MAF coal basis), liquid residence times ranging from about 5 to about 130 minutes, and preferably from about 10 to about 60 minutes.

The product from the coal liquefaction zone 20 consists of gases and liquids, the liquids including a mixture of undepleted hydrogen-donor solvent, depleted hydrogen-donor solvent, dissolved coal, undissolved coal and mineral matter. The liquid mixture is transferred into a separation zone 30 wherein light fractions boiling below 400° F. useful as fuel gas are recovered, and intermediate fractions boiling, e.g., from 400° F. to 850° F. are recovered for use as a hydrogen donor solvent. Heavier fractions boiling from about 700° F. to 1000° F. are also recovered, and bottoms fractions boiling above 1000° F., including char, are withdrawn for use in the gasification process or for coking, as desired.

The solvent fraction, or 400°–850° F. fraction, is introduced into a solvent hydrogenation zone 40 and hydrogenated in the presence of a quinone catalyst to upgrade the hydrogen content of that fraction. The conditions maintained in hydrogenation zone 40 effectively hydrogenate and, if desired, conditions can be provided which produce substantial cracking. Temperatures normally range from about 500° F. to about 1000° F., preferably from about 750° F. to about 900° F., and pressures suitably range from about 650 psig to about 2000 psig, preferably from about 1000 psig to about 1400 psig. The hydrogen treat rate ranges generally from about 500 to about 10,000 SCF/B, preferably from about 1000 to about 5000 SCF/B.

These and other features of the present process will be better understood by reference to the following exemplary data. All units are in terms of weight unless otherwise specified.

EXAMPLES 1–7

For demonstrative purposes, a series of runs were conducted to quantify the catalytic activity of various quinone catalysts toward the production of hydroaromatic compounds from naphthalene. The hydroaromatic compounds produced are characteristic of those which donate hydrogen in donor solvents. The relative activity of a particular quinone catalyst toward the production of donor solvent type molecules from naphthalene can be taken as its relative activity toward regeneration of the donor solvent itself.

In conducting this series of runs, 2.0 gram portions of naphthalene feed, with 0.1 gram of added quinone catalyst, (5 wt. % added quinone) were charged into stainless steel tubing having an internal volume of 30 cc. The bombs were charged with 500 psig molecular hydrogen gas at room temperature, sealed, and submerged horizontally in a constant temperature sandbath to provide the desired reaction temperature. During the runs, the bombs were agitated at 120 cycles per minute for 130 minutes in the fluidized sandbath heated sufficiently to provide a temperature of 840° F. The total pressure was 1500 psig at 840° F. The products were analyzed using mass spectrometry with the results shown in the following Table 1.

Table 1

| Catalyst | % Hydroaromatics Formed |
|---|---|
| None | 2 |
| 9,10 anthroquinone | 5 |
| p-hydroquinone | 7 |
| p-hydroquinone | 9 |
| tetrachloro-p-benzoquinone | 10 |
| p-quinhydrone | 14 |
| o-hydroquinone | 20 |

EXAMPLES 8-9

Another series of bombs, as used in the previous examples, were each charged with 3 grams portions of a spent hydrogen donor solvent. To all but one of these bombs, 5 weight percent of tetrachloro-p-benzoquinone was added. All of the bombs were charged with 500 psig of molecular hydrogen gas and then run as previously reported, i.e. at 840° F., 1500 psig total pressure and at a reaction time of 130 minutes to hydrogenate the feed. The products were analyzed to determine the percentage of the available hydrogen consumed to form hydroaromatic donor solvent molecules. The results are shown in the following Table 2.

Table 2

| Catalyst | % Hydrogen Consumed |
|---|---|
| None | 35.1 |
| tetrachloro-p-benzoquinone | 62.5 |

It is apparent that various modifications can be made in the process without departing the spirit and scope of the present invention.

Having described the invention what is claimed is:

1. A process for liquefying a particulate coal feed to produce useful petroluem-like liquid products, which comprises: (a) contacting, in a liquefaction zone, said coal feed with a hydrogen donor solvent at temperature and pressure sufficient to hydroconvert and liquefy the coal, (b) separating the product from the liquefaction zone into fractions inclusive of a liquid solvent fraction which contains at least 30 weight percent hydrogen donor compounds, (c) hydrogenating said liquid solvent fraction in a hydrogenation zone in the presence of an added quinone, compound and (d) recycling the hydrogenated liquid solvent mixture to said coal liquefaction zone.

2. The process of claim 1 wherein the liquid solvent fraction contains at least 50 weight percent of hydrogen donor compounds.

3. The process of claim 2 wherein the liquid solvent fraction is one boiling within about a 350° F. to 850° F. range.

4. The process of claim 1 wherein the quinone compound is added to the solvent in concentration ranging from about 0.01 to about 5 percent, based on the weight of the feed.

5. The process of claim 4 wherein the concentration of the quinone compound ranges from about 0.1 to about 2 percent.

6. The process of claim 1 wherein the liquid solvent fraction, after hydrogenation, contains at least about 0.8 percent donatable hydrogen.

7. The process of claim 6 wherein the liquid solvent fraction, after hydrogenation, contains from about 1.2 to about 3 percent of donated hydrogen.

8. The process of claim 1 wherein the liquid solvent fraction is one boiling within about a 350° F to 850° F range.

9. The process of claim 8 wherein the liquid solvent fraction is one boiling within the 400° F to 700° F range.

10. The process of claim 2 wherein the quinone compound is added to the solvent in concentration ranging from about 0.01 to about 5 percent, based on the weight of the feed.

* * * * *